US005425800A

United States Patent [19]

Buter et al.

[11] Patent Number: 5,425,800

[45] Date of Patent: * Jun. 20, 1995

[54] RECOVERY OF PRECIOUS METAL VALUES FROM REFRACTORY ORES

[75] Inventors: Larry J. Buter, Highlands Ranch, Colo.; Douglas R. Shaw, Salt Lake City, Utah

[73] Assignee: FMC Corporation, Philadelphia, Pa.

[ * ] Notice: The portion of the term of this patent subsequent to Aug. 17, 2010 has been disclaimed.

[21] Appl. No.: 143,318

[22] Filed: Oct. 26, 1993

[51] Int. Cl.[6] ..... C22B 11/00; C01G 55/00; C01B 21/40

[52] U.S. Cl. ..... 75/744; 423/27; 423/29; 423/28; 423/394.2; 423/22

[58] Field of Search ..... 423/27, 29, 28, 394.2, 423/22; 75/744

[56] References Cited

U.S. PATENT DOCUMENTS

| | | | |
|---|---|---|---|
| 636,114 | 10/1899 | Cain et al. | 423/29 |
| 1,810,487 | 6/1931 | Lawr | 423/29 |
| 3,099,529 | 7/1963 | Hatch et al. | 423/394.2 |
| 3,793,429 | 2/1974 | Queneau et al. | 423/34 |
| 3,888,748 | 6/1975 | Brennecke | 204/108 |
| 4,331,469 | 5/1982 | Kunda | 423/34 |
| 4,647,307 | 3/1987 | Raudsepp et al. | 75/118 R |
| 4,670,051 | 6/1987 | Schneider | 423/27 |
| 4,834,793 | 5/1989 | Schneider et al. | 423/27 |
| 4,878,945 | 11/1989 | Raudsepp et al. | 423/27 |
| 4,898,611 | 2/1990 | Gross | 423/27 |
| 5,013,359 | 5/1991 | Fair et al. | 423/27 |
| 5,196,052 | 3/1993 | Gross et al. | 423/DIG. 17 |
| 5,236,492 | 8/1993 | Shaw et al. | 75/744 |

*Primary Examiner*—Steven Bos

*Attorney, Agent, or Firm*—Frank Ianno; Robert L. Andersen

[57] ABSTRACT

A hydrometallurgical process is described for recovery of precious metals from ores refractory to treatment by lixiviating agents by crushing the ore to no finer than a nominal ¼ inch size, treating the ore with about 100% to about 300% of the stoichiometric amount of nitric acid required to react with the ore, maintaining the reaction mixture until the reaction is substantially complete, placing the treated ore in a permeable ore bed, washing the permeable ore bed to remove nitric acid, placing the washed ore in a heap permeable ore bed and passing a lixiviate solution for precious metals through the bed and recovering the dissolved precious metal from the lixiviate solution. All NOx gases generated during the reaction of nitric acid with the ore are recovered for conversion into nitric acid which is recycled for treating ore.

29 Claims, 1 Drawing Sheet

RECOVERY OF PRECIOUS METAL VALUES FROM REFRACTORY ORES

BACKGROUND OF THE INVENTION

1. Field of the Invention

The invention is in the field of hydrometallurgical treatment of refractory ore for the recovery of precious metal values which are not readily recoverable by the use of ordinary lixiviants. The most common of these refractory ores are the sulfur-containing ores that contain pyrite or arsenopyrite minerals.

2. Description of the Prior Art

With the depletion of reserves of high-grade ores, more interest is being focused on the recovery of gold and silver from "refractory" ores. Refractory ores are those ores from which common lixiviating agents, such as sodium cyanide or thiourea, are unable to leach high yields of a precious metal. The most common of these refractory ores are those that contain pyrite or arsenopyrite as sulfur-containing compounds and such ores are not readily amenable to treatment by leaching. Conventional technology for attempting to recover the precious metals from these refractory ores is first to crush the ores in a series of crushers to obtain a minus one quarter inch ($-\frac{1}{4}$ inch) product. This $-\frac{1}{4}$ inch product is then further ground to minus two hundred mesh ($-200$ mesh) (Tyler Series) and preferably to $-270$ mesh in order to assure good contact of the ore particles with the treating agent. In the next step, the ground ore is placed in an agitated reactor and treated with an oxidizing agent, such as nitric acid, under conditions of high temperature or high pressure or both. The use of autoclaves enabling pressures of 100 psig to be employed and elevated temperatures of 160° C. is technology known to the industry.

Subsequent to this ore oxidation, the resulting slurry is separated into residual solids containing precious metals such as gold and silver and a liquid fraction which contains solubilized, oxidized metal values. The residual solids then are treated to a standard, conventional extraction with lixiviants such as thiourea, sodium cyanide or other such treatment well known in the art. In this extraction stage, the residual solids from the oxidation stage are placed in an agitated vessel and treated with sodium cyanide solution or thiourea solution to dissolve the gold and silver from the residues of the oxidation step. Once solubilized, the gold and/or silver is recovered by known techniques such as carbon treatment, zinc displacement or the like.

One such patented process is described in U.S. Pat. No. 4,647,307 issued to Raudsepp et al. on Mar. 3, 1987. In this patented process, an ore concentrate containing arsenopyrite or pyrite is finely ground, for example, 60% $-200$ mesh, and treated in an autoclave to decompose the arsenopyrite in acidic solution in a common volume space through the action of an oxidized nitrogen species in which the nitrogen valence is at least $+3$. The reaction is carried out at about 80° C. and at elevated pressures. The active oxidized nitrogen species are regenerated in the same common volume space within the autoclave by the injection of oxygen under these super atmospheric pressures. Such oxygen is injected into the autoclave and maintained at a partial pressure of from about 50 psig to about 100 psig. To assure proper mixing of the ore in the autoclave, an agitator is employed to keep the concentrate in suspension and thereby assure good contact of the ore with the treating ingredients in the autoclave. After this reaction has decomposed the arsenopyrite and pyrite, the residual, fine solids can be treated for recovery of precious metals such as gold by conventional lixiviating techniques such as thioureation, cyanidation or the like in agitated treating vessels to assure good contact between the fine solids and lixiviants. In typical examples of the process, the concentrate employed contained about 7 ounces of gold per ton of concentrate and recovery of this gold was substantially increased when the preliminary oxidation step by an oxidized nitrogen specie was carried out.

U.S. Pat. No. 3,793,429 issued to Queneau et al. on Feb. 19, 1974 teaches a preliminary nitric acid treatment of copper sulfide ores and concentrates containing large amounts of copper and iron for recovery of the copper, silver and gold contained in the ore. In this process, the concentrate which contains about 28% copper, 25% iron, 3.5 oz/ton silver and 0.4 oz/ton gold per ton of concentrate is first ground to $-270$ mesh and subsequently leached with nitric acid at initially 90° C. followed by raising the slurry temperature to boiling for some hours. This action of the nitric acid converts the iron sulfide to hydrogen jarosite or equivalent iron precipitate. The concentrate after being treated by the nitric acid is subjected to a solids liquid separation. The liquid portion is subjected to intermediate purification and neutralization before it is sent to a copper electrowinning stage where copper is recovered. The solids portions which have been separated from the nitric acid leaching stage are treated in intermediate stages for removal of sulfur and unreacted sulfides, such as by froth flotation. Finally, the fine solids slurry is passed to multiple stages of cyanidation, normally carried out in agitated vessels, where the gold and silver are recovered from the insoluble jarosite.

These processes are difficult to carry out because they require high pressure and/or high temperature equipment such as agitated autoclaves and the like and are difficult to operate on a continuous basis and in large scale commercial operations. Further, the grinding or milling of the ore down to 200 mesh or 270 mesh is both time consuming and requires expenditure of large amounts of power. The initial crushing of the ore in stages down to a nominal $\frac{1}{4}$ inch to $\frac{3}{4}$ inch size is relatively easy and does not require excessive power inputs. However, the grinding and milling of the ore from these nominal sizes down to 200 mesh or 270 mesh requires separate milling operations with high power inputs and specialized grinding equipment. This can be avoided, of course, if the milling of the ore can be eliminated.

Another difficulty is that while the industry is attempting to recover precious metals from low grade refractory ores, the ores which are commonly utilized today contain at least 0.1 ounce of gold per ton of ore in order to assure an economic process. In general, the very low grade refractory gold ores, such as those that contain below 0.1 ounce of gold per ton, many of which contain only 0.05 ounces of gold per ton of ore, are generally too low grade to be processed economically by the known oxidative techniques illustrated in the two patents above, or by other known techniques including roasting or the use of autoclave processing.

Further, these prior art processes do not permit treatment of the chemically oxidized, refractory ores by an economically preferred process for leaching precious metals, namely, heap leaching. The slurry of fine solids obtained after chemical oxidation cannot be stacked in heaps (or beds) which are permeable to treatment with a lixiviant distributed on top of the heap. Washing of such slurry heaps to remove and recover any chemical oxidants and/or lixiviant solutions therefrom is equally impossible because of their impermeability to any washing or treating solutions. In general, heap treatment is normally reserved for treating naturally, not chemically, oxidized siliceous, carbonate-containing ores which are not very highly refractory to lixiviating solutions and thus need no fine grinding and preliminary chemical oxidation.

SUMMARY OF THE INVENTION

In accordance with the present invention, a hydrometallurgical process for recovery of a precious metal from an ore which is refractory to treatment by lixiviating agents is described which comprises the following steps:

(a) crushing the ore to no finer than about a nominal $\frac{1}{4}$ inch size, (b) treating the ore with about 100% to about 300% of the stoichiometric amount of nitric acid required to react with the ore, maintaining the reaction mixture for a sufficient residence time to essentially complete the reaction, and recovering NOx gas evolved from the ore, (c) placing the thus-treated ore in at least one permeable ore bed, (d) water washing the permeable ore bed to remove nitric acid therefrom, and separating the washings from the bed, (e) placing the washed ore in a heap permeable ore bed on top of an impermeable collector, (f) treating the heap permeable ore bed by dispersing continuously or intermittently a lixiviate for precious metals through the bed, (g) separating the lixiviate solution containing dissolved precious metals from the heap permeable ore bed and recovering said precious metals from the lixiviate solution.

The present invention is based on applicants' discovery that permeable beds of crushed refractory ore can be formed from chemically oxidized ore which beds are suitable for washing and for treatment by heap leaching. This requires that the ore be crushed to a relatively large size, that is, no finer than about $\frac{1}{4}$ inch nominal crush, without further milling of the ore to the usual −200 mesh (Tyler). If the crushed size of the ore is larger, that is, about $\frac{3}{4}$ inch to 1 inch, this ore size will usually yield a permeable bed without any further step. However, if the crushed size is about $\frac{1}{4}$ inch, depending on the amount of fines, it may be necessary to utilize additional binders to agglomerate particles of the ore in order to yield a permeable bed.

DETAILED DESCRIPTION OF THE INVENTION

Figure 1:
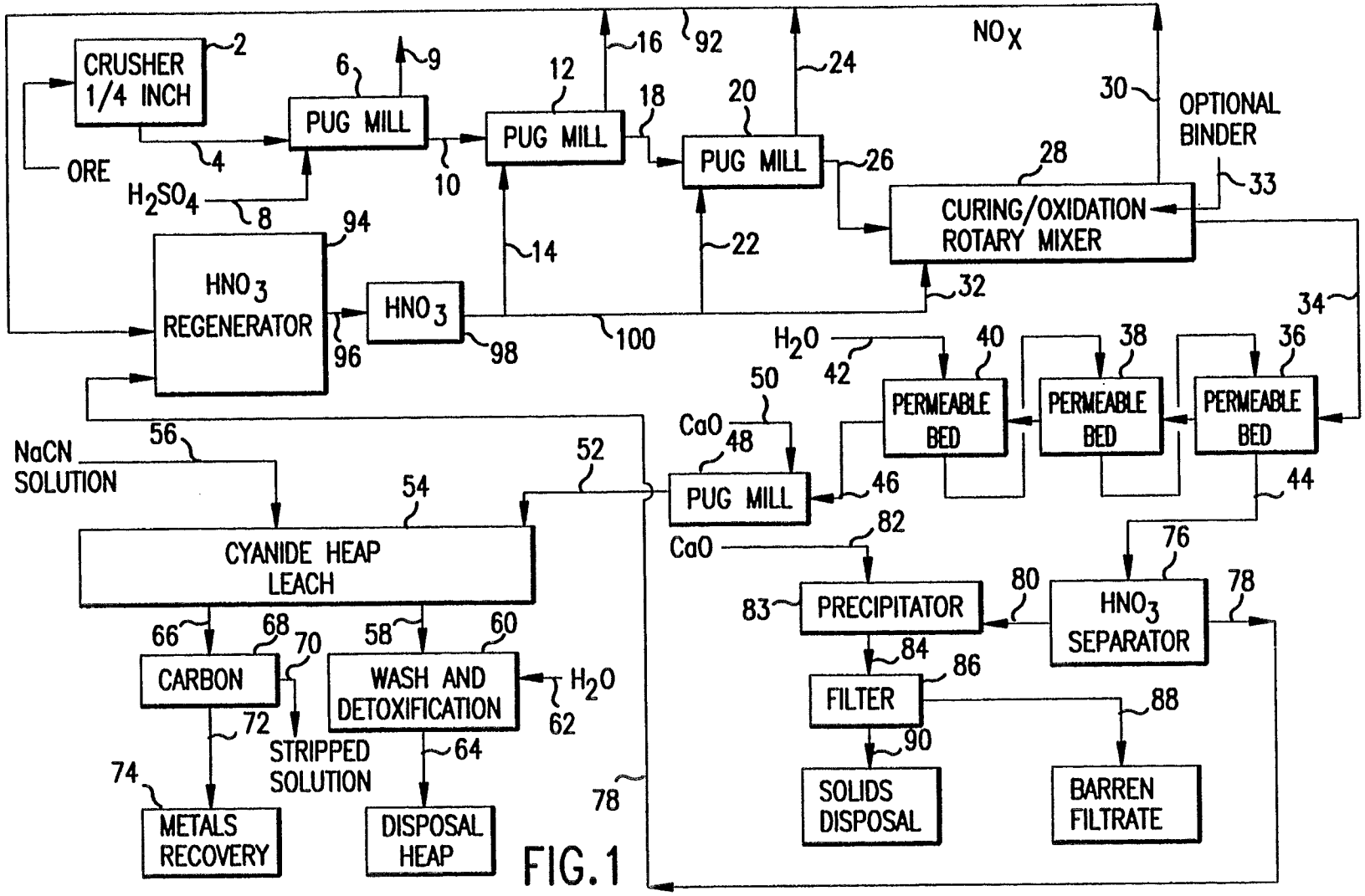
FIG. 1 illustrates a flow sheet of the process of the invention in block form.

In carrying out the present process, the ore which is employed is one that contains precious metals such as gold, silver or one of the platinum group metals, and which is refractory. Such ores are refractory when the precious metals cannot be extracted by conventional hydrometallurgical processes such as cyanidation, even when ground finely, because substantial amounts of the precious metals remain unaffected and unleached in the ore. Typical of refractory ores are those that contain substantial amounts of pyrite ($FeS_2$) or arsenopyrite (FeAsS) as the principal sulfides. Typically, the precious metals are associated structurally with sulfur and, therefore, are not easily accessed by lixiviants until the sulfur lattice is decomposed. The instant process is capable of treating refractory ores containing gold in amounts below about 0.1 ounce per ton of ore, and even gold quantities in amounts of 0.05 ounce and below per ton of ore, in an efficient and economical manner. This is in contrast to prior art processes in which a level of about 0.1 ounce of gold per ton of ore is the smallest amount of gold in the refractory ores which can be treatable by conventional oxidative techniques such as autoclaving or roasting followed by conventional gold leaching.

The above refractory ore is prepared for treatment in accordance with the present process by crushing it to no finer than about a "nominal $\frac{1}{4}$ inch" crushed size. By "nominal $\frac{1}{4}$ inch" size is meant crushing to yield the maximum amount of particles having $\frac{1}{4}$ inch as their one largest dimension, but some particles, depending on the friability of the ore, will be finer than $\frac{1}{4}$ inch. Nominal crush sizes as large as $\frac{3}{4}$ inch to 1 inch are also desirable and work very well in the instant process. Further milling of the ore to particles substantially smaller than a nominal $\frac{1}{4}$ inch crush is not desired since it will adversely affect the required porosity of the ore bed in latter stages to be discussed below.

In the first step of the process, the ore after being crushed as set forth above preferably is treated with a mineral acid which reacts with the acid-consuming minerals in the ore and permits the aqueous phase of the slurry in contact with the ore to reach a pH of about 2 or below, and preferably pH of 1 and below. The preferred mineral acid used is sulfuric acid although any mineral acid such as hydrochloric, nitric or phosphoric acid can be employed. Sulfuric acid is preferred because it is inexpensive, readily available, and is very effective in converting the acid-consuming minerals into water-soluble sulfate salts and reducing the aqueous liquor in contact with the ore to a pH of at least 2 and preferably about 1. The acid-consuming salts which react with the mineral acid include calcium salts, present mainly as calcium carbonate, calcium oxide and in solution as calcium hydroxide; magnesium, present as magnesium carbonate, magnesium hydroxide or magnesium oxide; and, in general, most cation species which are well known to consume acid. When the salts are reacted with sulfuric acid they are converted to their corresponding metal sulfates. Illustrative of this reaction is that which takes place between calcium salts and sulfuric acid shown below:

$$H_2SO_4+CaCO_3 \rightarrow CaSO_4+H_2O+CO_2$$

In general, a high strength acid is employed during this first treating step. For example, if sulfuric acid, the preferred mineral acid is employed, it is used in about 98% by weight $H_2SO_4$. Enough acid is added to the ore to bring the pH of the aqueous phase of the mixture in contact with the ore to a pH of about 2 or below and preferably about 1 or below. In general, when sulfuric acid is employed it is found that amounts of from 5 pounds to 30 pounds of sulfuric acid (100% $H_2SO_4$ basis) is required per ton of ore being treated.

Since the initial mineral acid that is added to the ore functions primarily to acidify the ore and react with acid-consuming minerals it is desired to use the least expensive mineral acid that can achieve the dual ends of reacting with the acid-consuming minerals of the ore and further reducing the pH of the aqueous phase in contact with the mixture to a pH of 2 or below. This avoids consumption of more expensive nitric acid which is used in the second step of the process for oxidizing the crushed ore. This first stage is preferably carried out in some kind of rotary mixer or pug mill which allows intimate contact of the mineral acid and the crushed ore. If sulfuric acid is used as the mineral acid, the reaction between the crushed ore and the mineral acid may liberate carbon dioxide which can be vented without difficulty to the atmosphere. Such reaction will occur only in the presence of carbonotite minerals; in the absence of these minerals, no $CO_2$ evolution will occur. However, if for some reason nitric acid is employed as the preliminary treating mineral acid some NOx gases may be liberated and these must be collected and recycled along with other NOx gases which are collected elsewhere and recycled as set forth below. Since it may be necessary to collect the gases emanating from the reaction of the crushed ore and the primary mineral acid, if this acid is nitric acid, it is desired to utilize equipment which is closed and facilitates collection and recycle of any NOx gases which are liberated. In industrial practice, rotary mixers and pug mills from which evolved gases can be collected are preferred. These rotary mixers are in the form of inclined elongated tubes or cylinders mounted on rotating supports which turn the elongated tubes and permit the contents of the tube to be constantly mixed as it proceeds from one end of the tube to the other. The mixer can also employ an internal screw or paddles, if desired, to enhance contact of the ore and mineral acid, as is typical of pug mills. Mixing can also be accomplished using various pug mills, rotating pans, discs, and other forms of pellitizing devices. Mixing of the mineral acid and crushed ore can also take place in any equipment designed to tumble, agglomerate and/or pelletize mixtures. The reaction of the ore and mineral acid can be carried out at ambient temperatures and atmospheric pressures. It is preferred to employ concentrated mineral acids in this treating step to avoid having excessive amounts of liquids, for example, greater than about 12% by weight, mixed with the crushed ore since larger amounts of liquid make the mixture difficult to work with in the rotary mixers. While amounts of liquids greater or less than the 12% by weight may be employed it is preferred to use that quantity of liquid which will ensure easily handling of the ore mixture and this will vary depending on the make up of the various ores.

In the second step of the process, the acidified ore is treated with nitric acid in one or more rotary mixers or pug mills in order to carry out a preliminary oxidation step. Mixing of the acid and ore may also be accomplished by tumbling, agglomerating or pelletizing the crushed ore with the acid. This preliminary oxidation step can be carried out at ambient temperatures and atmospheric pressures. The nitric acid used in the second step has a relatively high concentration, from about 20 weight percent to about 70 weight percent $HNO_3$. In this step, only a portion of the nitric acid that is used to react with the ore in the instant process is added. This amount may vary from 5% to 200% by weight of the stoichiometric amount of nitric acid required to react with the sulfides or arsenopyrite in the ore. The purpose of adding only a part of the nitric acid during this second step is to permit the most vigorous part of the reaction to take place in a rotary mixer or pug mill, where NOx which is liberated rapidly and vigorously, can be recovered from the mixer and be available for recycle as set forth below. In general, when nitric acid is first added to the ore the initial phases of the reaction are very vigorous with large quantities of NOx being evolved. In order to reduce the cost of the nitric acid being used in the process, the large quantities of NOx which are given off in the early phases of the reaction are recovered and recycled for conversion back into nitric acid for reuse in the process. The amount of nitric acid which is employed in this step is that amount which permits completion of the most vigorous portions of the reaction to take place. As larger amounts of nitric acid are used in this step, it will be seen that the reaction intensity in the later stages of the reaction will diminish as will the evolution of NOx. The remaining amount of nitric acid required to completely treat the ore is utilized in a separate step downstream.

The function of the added nitric acid is to oxidize the pyrite and arsenopyrite in the ore thereby removing the refractory nature of the ore. The sulfides and arsenopyrite are oxidized by nitric acid in accordance with the following overall equations:

$$2FeS_2+10HNO_3 \rightarrow Fe_2(SO_4)_3+H_2SO_4+10NO+4H_2O \text{ and}$$

$$3FeAsS+14HNO_3+3H^+ \rightarrow 3Fe^{+3}+3SO_4^{-2}+3H_3AsO_4+14NO+4H_2O$$

In the third step of the process, the curing/oxidation step, the acid treated ore, with or without a binder treatment as specified hereinafter, is allowed sufficient residence time to permit all prior and subsequently added nitric acid to penetrate the ore completely and essentially complete the oxidation. This step is normally carried out in a separate piece of equipment, a closed reactor in which the ore and nitric acid are mixed and preferably a rotary mixer or other mixing equipment which permits an extended residence time of from about 1 to about 12 hours, preferably 3 hours. Additional nitric acid, having a concentration of about 20 weight permit to about 70 weight percent is added to the rotary mixer to essentially complete the nitric acid oxidation reaction. The nitric acid is added in amounts of from about 50% to about 200% of the stoichiometric amount required by the ore and supplements the initial nitric acid added in one or more previous steps to carry out the preliminary oxidation. The total nitric acid employed overall can be from about 100% to about 300% of stoichiometric. This curing/oxidation step can be carried out at ambient temperatures and under atmospheric pressures similar to the prior steps. However, due to the heat of reaction of $HNO_3$ with the sulfides, the temperature of reaction will increase and can reach from about 45° C. to about 85° C. Such higher reaction temperatures reduce the time required for the oxidation reaction. At elevated temperatures of about 75° C., the reaction will be essentially complete in about three hours.

During this curing/oxidation step, the nitric acid being initially or continuously added to the ore and some of the nitric acid which has been previously added in the second stage will continue to react with the ore to oxidize the sulfides and to form NOx. In the interest of recapturing as much NOx as possible, this NOx should be recovered with the other NOx which is formed in step 2 (preliminary oxidation) and step 1 (acidification step when carried out with nitric acid) for recycle in reforming additional nitric acid. At the end of this third step (curing/oxidation), the amount of NOx formed by any continuing reaction of the nitric acid and the ore will be very small with virtually all of the NOx formed during this and the prior steps having been collected and recycled for production of additional nitric acid. The oxidation steps may also be combined and carried out in one step or in one reactor.

In general, wet agglomerates of ore which have formed in the second step preliminary nitric acid treatment and which have been cured in the third step curing/oxidation stage for sufficient residence time may have sufficient strength and porosity to permit the resulting ore to be formed into permeable beds for subsequent treatment. However, in some cases such ore may require addition of an optional binder which performs an agglomerating function to assure such treated ore from the third step can be formed into permeable beds.

By permeable beds is meant the state where the treated ore can be placed in beds which are sufficiently permeable that liquid treating agent applied at the top of the bed will readily permeate through the bed and thereby contact the particles of the ore, without agitating, mixing or like of the bed.

At the outset, it should be noted that nitric acid when added to the ore in the prior step itself acts as a binding agent to aid in agglomeration of any fines in the ore. The need for agglomeration of the ore with added binding agents is determined by two factors. One is the amount of fine grain particles, for example, finer than 150 mesh or 200 mesh, in the crushed ore. The more fines the greater the likelihood will be of an impermeable condition, and, therefore, the greater the need for agglomerating the ore with binding agents. In general, the fine grain particles are caused by crushing the ore to the smaller size specifications. For example, ore crushed to a nominal ¼ inch crush will have more fines than an ore crushed to a nominal ¾ inch size. The second factor is the degree of particle decrepitation or disintegration that will occur due to the reaction of the acids. This depends on the mineralogical and textural characteristics of the ore that is being treated and how it behaves when acid treated, particularly when it is oxidized with nitric acid. Again, a large amount of particle decrepitation increases the chance for an impermeable bed and requires agglomeration with an added binder.

In certain ores treated by applicants where the amount of sulfides that are subject to chemical attack is relatively small, the amount of particle decrepitation is negligible and is not a factor. In these ores, the amount of fines in the samples determine the need for using a binding agent. This is best illustrated by comparison of an ore crushed to a nominal ¾ inch size and the same ore crushed to a nominal ¼ inch size. The ¾ inch crushed ore has a substantially coarser particle size distribution and much less fine grain particles than does the ¼ inch nominal crush sample. The ¾ inch nominal crush sample needed no binding agents in the instant process since it readily formed permeable beds after initial treatments with sulfuric acid and nitric acid, while the nominal ¼ inch crush sample which had a higher percentage of fine grain particles required agglomeration with an added binder in order to produce permeable beds of the ore.

When agglomeration with a binder is required, an acid resistant binder is dispersed in water by high shear mixing to form a very dilute dispersion of the binder, for example, below about 1% by weight and preferably about 0.5 weight percent by weight of the binder. This is then sprayed or otherwise dispersed on the surface of the ore while the ore is being mixed in equipment such as a rotary mixer or the like. The binder is preferably added during the third step curing/oxidation stage directly and continuously into the rotary mixer employed in this step. However, it is possible to add the binder in a preliminary or subsequent mixing step. The total amount of binder used need not be very high in that less than 1 pound per ton of ore has been found sufficient for this purpose. Specifically, amounts of 0.64 pound of binder per ton of ore and 0.4 pound of binder per ton of ore, and as low as 0.2 pound of binder per ton of ore have been successfully used in different runs in which the process has been successfully carried out.

The acid resistant binders which have been found operable include CELLULON TM, a Weyerhaeuser Company product which is a reticulated network of micron-sized needle-shaped solid cellulose fibers. The product has a fiber diameter of 0.1 micron, a surface area of 260,000 cm 2/gram and its solid form composition is 15 to 20 weight percent bacterial cellulose, 1% by weight maximum of lipopolysaccharide and 79 to 85 weight percent water. Also, AVICEL TM microcrystalline cellulose, an FMC Corporation product, can be used as the binder. AVICEL TM is a purified depolymerized native cellulose in spherical-shaped microcrystalline form. Another useful binder is NALCO TM agglomeration aid, a Nalco Chemical Company product, which is a polyacrylamide polymer flocculant supplied in a hydrocarbon solvent and water.

It is essential that the binding agent used for agglomeration be stable and not otherwise affected by acidic conditions, especially at the pH of about 1 which is the normal pH of the acidified ore after nitric acid treatment. Conventional agglomerating agents used in the prior art for other purposes such as lime or lime and cement cannot be used as a binder in the acidic oxidation steps of this process. In such conventional processes, lime acts as the coagulating agent for the fines while cement sets up the agglomerates into hard particles. However, at acid pH's of about 1 such reagents react with these basic elements and lose their agglomerating properties. The binder should also be capable of being stable under alkaline conditions, for example, at pH values of 10 and above, when a downstream cyanidation is to be carried out which requires treatment of the ore and binder under such alkaline conditions. All of the above binders are workable under such acid and/or alkaline conditions.

After the curing/oxidation reaction, with or without a binder, has been essentially completed, the ore is removed from the rotary reactor and stacked to form permeable beds. The beds can be formed in shallow filter vessels, filter towers or on a moving filter belt and may range from about six inches to many feet high. Water is distributed on top of the bed and allowed to permeate through the bed and wash the ore. The water wash is continued until there is a substantial increase in its pH indicating a substantial removal of the residual nitric acid in the heaped ore. The water wash has two purposes. Initially, it seeks to recover substantial portions of unreacted nitric acid which remains in the heaped ore. Further, the water wash dilutes and removes the last traces of residual liquor in the heaped ore that contains dissolved metal sulfates, metal acids, or sulfuric acid, if any remains unreacted. It is important in carrying out the instant process that the sulfate and nitrate ions be removed by the water wash from the ore either completely or in such substantial amounts that any residual sulfates and nitrates do not present disposal problems or interfere with the next step which is the neutralization step. In general, when the water wash is carried out to a point where the recovered wash water has a pH of about 3 or above, the wash has been sufficient to eliminate the troublesome sulfate and nitrate ions from the heaped ore.

In the next stage, the washed ore is neutralized by mixing the ore with lime or other suitable alkaline calcium, sodium or magnesium compounds to raise the pH of the ore to a value of 10 or above. Calcium carbonate, calcium hydroxide, calcium oxide, sodium hydroxide or magnesium hydroxide and the like are all suitable for this purpose. The neutralization is carried out to prepare the heaped ore for subsequent lixiviation with sodium cyanide solution. During this neutralization stage, little or no gypsum is formed on the ore because of the elimination or substantial removal of the sulfate ion from the ore during the washing step. The neutralization step is carried out by mixing the washed ore with lime or other alkaline compound mentioned above in a suitable mixer such as a pug mill or rotary mixer, with or without internal screws or paddles.

It is necessary to raise the pH of the washed ore to at least about 10 in order to prepare it for lixiviation with materials such as sodium cyanide. A pH of at least 10 is required to avoid the possible reaction of sodium cyanide and formation of hydrogen cyanide which is volatile and toxic.

It is unusual to carry out a neutralization step starting with an ore slurry having a pH of about 3 and raise it to pH 10 and above when the ore bed has contained sulfate without precipitating gypsum or other insoluble calcium salts. The precipitation of gypsum throughout the ore bed cannot be tolerated. If such gypsum were to precipitate, it would tend to diminish the permeability of a bed of the ore and would form a coating on the exterior of the ore which would hinder contact of any subsequently added lixiviating solution with the ore and extraction of the precious metal values.

The essentially complete removal of residual nitric acid reagent carried out previously in the washing step is an essential step prior to adding the alkaline compound in this neutralization stage. Otherwise, the residual nitric acid will react with the alkaline compound, such as lime or caustic soda, to form soluble calcium nitrate or sodium nitrate, respectively, which create a serious disposal problem. Such soluble nitrates cannot be impounded in the ground but must be treated by expensive chemical treatment until converted to acids or another environmentally acceptable disposable form. In the instant process, it is unlikely that any undesired solid gypsum or soluble calcium or sodium nitrates will be formed on adding the alkaline compound because of the efficient washing that can be carried out when the ore is capable of being formed into permeable beds as previously described.

In the next step, the neutralized ore is placed in a heap and lixiviation of the heap is carried out. In this specification and claims, the term "heap" or "heaped ore" treatment is meant to convey the method of treating ores by placing them in heaped beds or piles, normally outside and in the open, and stacking in lifts up to heights of about 200 feet and which rest on an impermeable collector or other conventionally used liner normally employed for liquid recovery in heap treatment. The heaped ore must be in permeable piles or beds which are then conventionally treated by some liquid which is sprayed or otherwise distributed on top of the heaped ore and allowed to permeate downwardly through the bed. The liquid contacts the particles in the bed for whatever chemical or physical treatment is to be carried out, such as, for example, selective dissolution, and recovered liquids are collected from the liner.

The treated ore from the previous neutralization step is placed in a heap on an impermeable collector such as a polyethylene sheet, but in which the heaped ore forms a permeable bed. A dilute solution of sodium cyanide, typically having a concentration of from about 0.01 weight percent to about a 1.0 weight percent NaCN, preferably from about 0.01 weight percent to about 0.2 weight percent, is then distributed on top of the heaped ore by spraying or drip and permitting the dilute sodium cyanide to permeate downwardly through the bed and react with the ore. This added, dilute NaCN treatment is carried out for extended periods of time, for example, 2 weeks to 4 weeks, normally at ambient temperatures and under atmospheric pressures. Liquor which is added to the top of the heap and which penetrates the permeable bed of ore is constantly collected on the impermeable collector and separated from the solid ore.

The instant heap lixiviation must be distinguished from conventional heap lixiviation as carried out in the art in which the heap treated ores are essentially nonrefractory and thus do not require a preliminary chemical oxidation before heap lixiviation. Such non-refractory ores can be treated while in relatively large lumps by stacking them into heaps and simply heap lixiviating them without the need for a preliminary chemical oxidation. Their relatively coarse size permits them to be heaped into heaps that are permeable to a lixiviating solution. By contrast, refractory ores have typically required fine grinding, i.e., −200 mesh, to permit a preliminary chemical oxidation to be carried out, and these fine ground ores cannot be placed into heaps for treatment because they form impermeable heaps. The instant process, by contrast, permits treatment of a refractory ore by both chemical oxidation and subsequent heap lixiviation by enabling the fine ground, chemically oxidized ore to be stacked into beds or heaps that are permeable to the lixiviating solution.

In carrying out the present lixiviating step, the preferred lixiviate is an aqueous solution of sodium cyanide because it yields the highest gold recovery of tested lixiviates. However, other lixiviates such as thiourea solutions can also be employed; however, since it functions under acid conditions, neutralization of the ore to pH 10 by addition of an alkaline compound is not required. In either case, the lixiviate that is percolated through the bed and dissolves the gold and precious metals is recovered from the impermeable collector at the base of the heap and separated from the solid ore. This pregnant lixiviate is then passed through a carbon bed or otherwise treated with zinc to recover the gold and precious metals by known technology. The remaining permeable heaped ore bed is washed to detoxify the residual cyanide and the washed ore is disposed of in a heap.

In the foregoing description, an alkaline compound such as lime was added to washed ore by blending the ore and lime in a pug mill or rotary mixer before the ore was stacked into heaps and subject to lixiviation. Such treatment is preferred because the dried lime will take up water from the washed ore and make a more workable, less sticky, ore mixture that is easy to handle. However, it is also possible to place the washed ore directly into permeable heaps and treat it with milk of lime, lime-saturated and clarified water or other suitable aqueous mixtures of alkaline calcium, sodium or magnesium compounds described above, to raise the pH of the liquid emanating from the heaped ore to a pH of 10 or above. Thereafter, the heaps of ore can be treated directly with lixiviate, in place, without disturbing the heaped ore. This procedure eliminates the necessity of a separate step for passing the washed ore and lime through a pug mill or other mixing device before stacking the ore in a heap.

The key to these various treatment of the ore whether in beds or in a heap is the maintenance of a permeable body of ore so that the treating liquor which is dispersed over the top of the ore body can permeate through it and contact the ore particles within. This applies to washing the bed or beds of chemically oxidized ore and lixiviating of heaps of the ore. Each of these treating steps can be carried out at ambient temperatures and under atmospheric pressures.

To increase the efficiency of the process and reduce the amount of treating chemicals required, recovery and recycle techniques are employed wherever cost effective. For example, the residue liquor recovered from the step of washing the oxidized ore which contains unreacted nitric acid as well as dissolved metal sulfates and acids is treated in a recovery stage to recover the unreacted nitric acid from the liquor. This nitric acid recovery can be done by feeding this residue liquor into an ion exchange or electrodialysis unit which separates the residual nitric acid from the remaining liquor. In the case of ion exchange, the acid is adsorbed selectively with a weak base resin as follows:

$$R(\text{empty resin site}) + H^+ + NO_3^- \rightarrow R\text{-}HNO_3^-$$

Elution of the resin with water yields dilute $HNO_3$ which can then be recycled.

The effluent from such ion exchange unit which contains metal sulfates is treated with calcium carbonate, calcium oxide, or other suitable calcium salts until it reaches a pH of about 4.5, or to as high as pH 11 if desired. This results in a stable precipitation of metal sulfates, as shown below:

$$Fe_2(SO_4)_3 + 3Ca(OH)_2 + 6H_2O \rightarrow 2Fe(OH)_3 + 3CaSO_4.2H_2O \downarrow$$

$$2H_3AsO_4 + 3Ca(OH)_2 + 2H_2O \rightarrow Ca_3(AsO_4)_2 \downarrow + 6H_2O$$

$$H_2SO_4 + Ca(OH)_2 \rightarrow CaSO_4.2H_2O \downarrow$$

$$2H_3AsO_4 + Fe_2(SO_4)_3 \rightarrow 2FeAsO_4 + 3H_2SO_4$$

The slurry is then filtered to remove barren filtrates from the residue which is disposed of in its stable form.

Another important chemical recovered in the process is NOx. This term covers the many oxides of nitrogen formed when $HNO_3$ is used as an oxidizing reactant, the most stable being NO and $NO_2$. Such NOx is recovered from the rotary mixers where nitric acid treatment, agglomeration, curing/oxidation and ore washing take place. The NOx is sent to a nitric acid generator, such as one of the commercially available air absorption generators, for conversion of the NOx into nitric acid. The nitric acid from the generator is then recycled for treating additional ore.

The process will now be described with reference to the drawing which is a flow sheet of the process in block form. In the first stage of the process, the mined ore is crushed in crusher 2 to a size no finer than about a nominal $\frac{1}{4}$ inch crush, for example, a nominally $\frac{1}{4}$ to $\frac{3}{4}$ inch crush. The crushed ore is conveyed via line 4 to a first pug mill mixer 6 where it is mixed with a mineral acid 8 and preferably concentrated sulfuric acid until it reaches a pH of about 1. This mineral acid is added to neutralize any acid-consuming minerals in the ore and to convert these minerals into a soluble form in the added acid. If sulfuric acid is utilized in this step, the gas generated in the pug mill mixer 6 and vented through line 9 will probably be carbon dioxide and this can be vented to the atmosphere after alkali scrubbing to remove any offending sulfur gases. However, if another mineral acid such as nitric acid is employed, then the reaction may liberate some NOx through line 9 and this should be recovered from the pug mill mixer 6. Since any mineral acid will achieve this neutralization reaction and solubilize the acid-consuming minerals it is preferred to use an inexpensive acid such as sulfuric acid to achieve this purpose. Further, it is desired to have the dissolved minerals present in their sulfate forms and sulfuric acid will achieve this objective readily. However, regardless of the mineral acid that is employed, some sulfates will form since pyrite and arsenopyrite in the ores will in part be converted to sulfates.

The ore resulting from the mineral acid treatment in vessel 6 is then passed through line 10 into a second pug mill mixer 12 into which nitric acid, preferably concentrated nitric acid, is added via line 14 into the secondary mixer 12. A vigorous reaction occurs in which the nitric acid oxidizes sulfide compounds and the like. The vigorous reaction releases much NOx gases from the mixer and these are removed via line 16 and recovered. The nitric acid is added in this stage in amounts of from 5% to 200% by weight of the stoichiometric amount of $HNO_3$ required to react with the sulfides in the ore.

The nitric acid treated ore from mixer 12 is then passed via line 18 into a third pug mill mixer 20 into which nitric acid is also added via line 22. This additional mixer 20 is employed to distribute the added nitric acid among a plurality of locations, increase the retention time of the partially reacted ore with additional nitric acid so as to better control the rate of reaction and thereby assure that the reaction is not too vigorous in any one mixing vessel. A plurality of mixers also permits more intimate mixing of the ore with freshly added nitric acid from line 22 and permits the newly added acid to react in a separate reactor 20. The use of pug mills is desirable in blending the ore with nitric acid in this process because they mix the acid and ore intimately and allow the acid to reach and oxidize all of the ore fed to them. However, they have relatively short retention times (on the order of 5 minutes or so) and it thus may require a plurality of such mixers if increased retention and reaction time is desired during this initial, very vigorous reaction that takes place. NOx gases generated during this vigorous reaction are removed from pug mill 20 via line 24 and recovered.

The preliminary oxidized ore from pug mill 20 is removed via line 26 into a curing/oxidation vessel 28. This vessel is a closed reactor in which oxidation of the ore is completed and is preferably an elongated rotary mixer, not unlike a rotary kiln, which is in the form of an elongated tube that is turned on rollers to mix the ingredients within the tube. The balance of nitric acid employed to treat the ore is then added through line 32 into the rotary mixer to complete the oxidation reaction. The rotary mixer which is in the form of an elongated tube, with gas seals at either end, can be as long as 200 feet in order to provide the retention time required for the reaction taking place in this rotary mixer. The retention time within the rotary mixer 28 may be from 1 to 12 hours with about 3 hours being preferred. This rotary mixer 28 performs a number of functions. Initially, the final segment of nitric acid added through line 32 permits complete oxidation of the ore over the extended residence time it remains in rotary mixer 28. The reaction in this rotary mixer is not as vigorous as that in vessels 12 and 20, previously described, but rather is designed to assure complete oxidation of the ore by the added nitric acid within the rotary mixer 28. This vessel also permits the nitric acid treated ore sufficient residence time to form firm wet agglomerates and to cure these agglomerates so that they will permit the formation of a permeable bed of the ore in subsequent treating stages. The formation and curing of these wet agglomerates in this rotary mixer is essential to proper treatment of the ore downstream where permeable beds of the ore must be formed for proper washing and leaching of the oxidized ore.

The nitric acid reactant from line 32 which is mixed with the ore in rotary mixer 28 acts as an agglomerating agent as well as a reactant and this reagent acting alone, or in combination with a binder subsequently discussed, will act to bind the fines into agglomerates provided there is sufficient residence time in the rotary mixer 28. However, in some cases where excessive amount of fines are present, an acid resistant binder 33 is added to the ore in rotary mixer 28 so that it is distributed throughout the ore body. The purpose of the binder is to obtain good agglomeration of any such fines that are in the ore and to assure that a permeable bed of the ore can be formed in subsequent stages of the process. The use of a binder is optional in that if the crushed ore is of sufficiently large size and the amount of fines in the ore is insufficient to cause plugging of a bed of the ore, the use of the binder can be eliminated. In all events, the retention time in the rotary mixer 28 must be sufficient to essentially complete oxidation of the ore and to assure that wet agglomerates of the ore have been formed and have cured into firm particles which will permit the formation of a permeable bed in subsequent stages. All NOx gases generated during this curing and oxidation stage are removed via line 30 and recovered. This curing/oxidation stage in rotary mixer 28 can take place at ambient temperatures and under atmospheric pressures. However, it has been found that at somewhat elevated temperatures, which result from the reaction of $HNO_3$ and sulfides, the reaction proceeds faster and thereby reduces the retention time required for the reaction. Accordingly, at reaction temperatures of between 45° C. and 85° C. the retention time in rotary mixer 28 can be reduced.

The ore which is undergoing treatment in the preliminary mixers 6, 12 and 20, and rotary mixer 28 should be kept as dry as possible by using concentrated reagents so that the amount of liquid in contact with the ore does not become excessive and make the mixture "sloppy" to handle, particularly in the final rotary mixer 28. In general, when the liquid level is controlled to no higher than about 12% by weight, the ore mixture can readily be handled in the pug mill mixers and the rotary mixer employed in mixing and reacting the reagents. Liquid levels above this value make handling of the ore more difficult.

The oxidized ore containing cured agglomerates is then removed from rotary mixer 28 via line 34 and stacked in at least one permeable bed 36. The permeable bed 36 may be anywhere from half a foot deep to several feet deep resting on a screen or some other permeable support. The permeable bed may be formed in vats, troughs or moveable belts which will permit a liquid to flow through the permeable bed. In the drawing a plurality of beds 36, 38 and 40 are shown which are washed countercurrently by water entering through line 42. In this countercurrent washing step, the initial permeable bed 36 is transferred downstream to beds 38 and 40 and washed countercurrently with the water from line 42 so that the final permeable bed 40 is always washed with fresh water coming in via line 42. The purpose of this washing step is to remove residual nitric acid from the oxidized ore along with any residual sulfate values and any metals dissolved in the acidic medium. The washing of the ore in these permeable beds must be carefully done to assure that in the subsequent neutralization stage no gypsum or soluble calcium or sodium nitrate is formed. The gypsum is undesirable because it coats the surface of the ore and prevents proper lixiviation of the gold and precious metal values in the ore. It also prevents the formation of a permeable bed of ore required for heap leaching downstream. Any calcium and sodium nitrate are undesirable since these create disposal problems that require expensive and elaborate post-treatments to convert these wastes into a form that can be disposed of in an environmentally compatible manner. The transfer of permeable beds downstream from one to the other during the washing stages can take place on a batch basis or if the beds are on movable belts the movement of the beds downstream can take place either batchwise or on an essentially continuous basis. In general, when the exit wash water in line 44 reaches a pH of about 3, the washing has been sufficient for these purposes. The wash water is removed via line 44 for recovery and reuse of the nitric acid values therein as described below.

The washed ore is removed from the permeable bed 40 and passed via line 46 into pug mill 48 where it is mixed with an alkaline substance such as lime that enters via line 50. The alkaline material added through line 50 can be calcium carbonate, calcium hydroxide, calcium oxide, sodium hydroxide or magnesium hydroxide. Enough is added so that the pH of the ore mixture is at least about 10. While any calcium compound which is sufficiently alkaline can be employed for this purpose, it is preferred to use lime because it readily absorbs water making the mixture less sticky and easier to work with in subsequent stages. Because of the excellent washing obtained by use of the permeable beds in the prior washing step, no gypsum or soluble nitrates are formed during the neutralization stage which interfere with subsequent heap leaching or which create soluble nitrates that must be disposed of by extraordinary means. This neutralization step in which the pH of the ore mixture is raised to at least about 10 is necessary if the lixiviate to be employed in subsequent treatments is an aqueous sodium cyanide solution, which is preferred. However, if other lixiviates such as thiourea are employed, this neutralization step can be eliminated since thiourea operates under acidic conditions.

The resulting ore from mixer 48, having now been neutralized to a pH of about 10 or above is susceptible to being lixiviated with sodium cyanide solution for removal of its precious metals.

The neutralized ore is removed from mixer 48 and passed via line 52 onto a heap permeable ore bed 54 on top of an impermeable collector (not shown). The heap may be stacked in lifts as high as 200 feet or less and is usually placed outside on conventional liners used in heap treatment such as polyethylene sheets of either low or high density or equivalent. An aqueous sodium cyanide solution is then distributed on top of the heap 54 via line 56 by spray or drip means that permit the dilute sodium cyanide solution to penetrate into and through the permeable bed contacting the ore particles as it flow downwardly through the bed. The cyanide solution leaches the gold, silver and other precious metals from the ore and solubilizes them in the pregnant solution which is removed via line 66 while the ore freed of its precious metals is conveyed by line 58 to a washing and detoxification stage 60 where water or oxidant is added via line 62 to detoxify it. Once detoxified, the resulting ore heap is passed via line 64 for disposal. Alternately, the residue can be left to operate with cyanide leaching for the purpose of long term recovery of a small amount of residual precious metals.

The pregnant solution 66 recovered from the heap leach operation 54 is then passed through a carbon column 68 and the precious metals such as gold and silver are adsorbed on the carbon. The solution stripped of its precious metals is removed via line 70 for recovery of the cyanide solution, recycled or otherwise disposed of. The carbon 68 loaded with gold or other precious metal is then passed via line 72 to a conventional metal recovery step 74 in order to recover the gold and other precious metal.

In order to minimize cost of reagents used in this process, the NOx gases which are recovered from lines 16, 24, 30 and possibly line 9 are collected together and sent via line 92 into a nitric acid regenerator 94 which can be of conventional design. Commercial air absorption generators are suitable for this purpose. The nitric acid thus regenerated is removed via line 96 and passed into a nitric acid storage area 98 which supplies nitric acid via a header 100 to vessels 12, 20 and 28.

Recovery of nitric acid from the wash water in line 44 is carried out by passing the wash water from line 44 into an ion exchange or electrode dialysis unit 76 where nitric acid is separated from the remainder of the liquid stream. The nitric acid which is thus separated is then passed via line 78 and recycled back to the nitric acid regenerator 94 to concentrate the acid before it is passed via line 96 into the nitric acid storage area 98. The residue liquor that is passed through the nitric acid separator 76 is removed via line 80 and is treated with calcium carbonate, lime, calcium hydroxide or other alkaline calcium compound which is added via line 82 to precipitate metal impurities in unit 83. The most common metal precipitates are gypsum, $Ca_3(AsO_4)_2$ and $FeAsO_4$. The precipitation is normally carried out so that the pH of the solution reaches about 4.5, although pH's up to about 11 are also acceptable. The slurry formed in precipitator 83 is then passed via line 84 to a filter 86 where the barren filtrate 88 is separated from the solids which are passed via 90 to disposal.

Example 1

Ore samples and Analysis

Baseline agitation leaching tests were performed on three gold ore samples; i.e., identified as A, B, and J, to establish the degrees of refractoriness and to determine the response of the ores to conventional nitric acid pre-leaching.

Chemical head assays of the ores were:

| Component | Ores Samples A | B | J |
|---|---|---|---|
| Au, oz/ton | 0.068 | 0.058 | 0.063 |
| Ag, oz/ton | 0.03 | 0.06 | 0.06 |
| $S_{Total}$, % | 1.72 | 2.70 | 2.62 |
| $SO_4$, % | 0.03 | 0.14 | 0.08 |
| $S^{2-}$, % | 1.68 | 2.55 | 2.60 |
| Fe, % | 3.21 | 3.54 | 2.98 |
| As, % | 0.66 | 0.194 | 0.234 |
| $C_{Total}$, % | 0.22 | 0.29 | <0.04 |
| $CO_2$, % | 0.30 | — | <0.03 |

These samples are from prospective commercially exploitable resources in the western United States. Ore sample A is a quartzite ore (QTZ) type, whereas ore samples B and J represent quartz monzonite (QMP) material. Samples A and B were composite samples of material drilled in the mineralized zones representing the two ore types of the ore deposit. Sample J was a laboratory split of an approximately 300 ton bulk sample that was excavated from an accessible area of the deposit.

Pyrite and arsenopyrite are the principal sulfide minerals. The ores consist principally of quartz, feldspar, abundant micas, and minor carbonate gangue. Silicification in the samples is small to moderate. However, ore sample A contains significantly more veined quartz than sample B or J, and, consequently, sample A has more sulfide encapsulation in dense, impermeable, quartz. Samples B and J, therefore, are more porous, as follows.

| Sample | Porosity, cc/kg | Surface Area, $m^2$/gram |
|---|---|---|
| A | 4.60 | 0.614 |
| B | 9.97 | 1.637 |
| J | 12.60 | 1.678 |

To determine the degree of refractoriness and the effectiveness of conventional nitric acid pre-leaching, baseline tests were performed on representative samples of ores A, B and J that were ground to 80% minus 200 mesh and agitation leached as follows.

| | Test No. 1 | 2 | 3 |
|---|---|---|---|
| Pre-Treatment | none | none | W/$HNO_3$ |
| % Solids | 40 | 40 | 40 |
| NaCN, g/l | 1.0 | 1.0 | 1.0 |
| CaO, pH | 11.5 | 11.5 | 11.5 |
| Aeration 1/ | yes | yes | yes |
| Carbon, g/l | none | 30 | 30 |
| Time, hours | 48 | 48 | 48 |

-continued

| | Test No. | | |
|---|---|---|---|
| | 1 | 2 | 3 |
| Temperature | ambient | ambient | ambient |

1/ Cyanidation stage only.

In Test No. 3, pre-treatment conditions were as follows:

Pre-acidification $H_2SO_4$: approximately 35 lb/ton of ore

Ore slurry pH: 1–2

Time: 30 minutes $HNO_3$ Oxidation $HNO_3$ added: approximately 160 lb/ton of ore sample A approximately 260 lb/ton of ore sample B and J Stoichiometry: 110% for $S^{2-}$ Temperature: 80° C.–90° C.

Pressure: atmospheric

Time: 4 hours

Headspace atmosphere: $N_2$

Final slurry pH: approximately 1.0

The acidic slurry in Test No. 3 was filtered, water washed, and neutralized before conducting conventional stirred cyanidation ($CN^-$) and cyanidation with carbon (CIL). The CIL test is carried out with conventional agitation or stirred cyanidation ($CN^-$) except that activated carbon is added to the cyanidation slurry. This prevents dissolved gold in the cyanidation solution from being adsorbed by, and thus lost to, any organic constituent of the ore ("preg-robbing") because the activated carbon has a much higher affinity for the gold than the organic constituent.

Baseline results were:

| Test/ Ore | Basis | Calculated Head Assays, oz Au/ton | Au Dissolns, % | Residue Assays oz Au/ton | NaCN Consump. lb/ton ore |
|---|---|---|---|---|---|
| 1-A | $CN^-$ | 0.066 | 9.2 | 0.060 | 2.2 |
| 2-A | CIL | 0.063 | 11.6 | 0.058 | 4.6 |
| 3-A | $HNO_3$/ CIL | 0.070 | 87.2 | 0.009 | 4.5 |
| 1-B | $CN^-$ | 0.058 | 9.6 | 0.062 | 5.3 |
| 2-B | CIL | 0.060 | 7.8 | 0.055 | 6.7 |
| 3-B | $HNO_3$/ CIL | 0.063 | 92.0 | 0.005 | 5.0 |
| 1-J | $CN^-$ | 0.059 | 6.0 | 0.055 | 6.8 |
| 2-J | CIL | 0.060 | 4.8 | 0.056 | 5.8 |
| 3-J | $HNO_3$/ CIL | 0.057 | 91.2 | 0.005 | 5.1 |

Oxidation/dissolution results in the nitric acid oxidation tests were:

| | Oxidation/Dissolutions, % | | |
|---|---|---|---|
| Sample | Fe | As | $S^{2-}$ |
| A | 67.5 | 86.8 | 88.4 |
| B | — | — | 93.7 |
| J | 81.2 | 91.6 | 88.4 |

These ores would be described as being nearly completely refractory based on cyanide-soluble gold contents of only approximately 6% to 10% without any oxidative pre-treatment (tests 1-A and 1-B) results. Therefore, the refractory nature of the ores was believed to be due to gold associated structurally with the arsenic and iron sulfide minerals. This is a common mineralogic occurrence and is a widespread cause of gold ore refractoriness.

The ores were readily amenable to nitric acid oxidative pre-treatment with gold recoveries in the $HNO_3$/-CIL tests of 87.2% to 92%. Sulfide sulfur oxidation was approximately 88% and typically over 86% of the arsenic was oxidized and solubilized.

Sodium cyanide consumptions were relatively high at approximately 2 to almost 7 pounds/ton of ore, even after nitric acid pre-treatment and agitation leaching. Lime (CaO) consumptions were from approximately 2 to 4 pounds/ton of ore.

Example 2

In the present example ore samples A, B and J, described and analyzed in Example 1, were treated by the instant process to the steps of nitric acid oxidation, followed by washing a permeable bed of the oxidized ore, neutralization with lime, and finally a cyanidation. In this example, for expediency the cyanidation step was performed by a bottle cyanidation test to rapidly obtain maximum gold dissolution under near equilibrium conditions. In commercial application, a heap leaching cyanidation step would be employed as demonstrated in Example 3 below. Bottle cyanidation tests are performed by mixing a sample with aqueous sodium cyanide in a bottle for 48 hours and separating and recovering the pregnant cyanide solution with its dissolved gold.

The ore samples were all crushed to a nominal ¼ inch and subject to chemical oxidation using rotating drums, sometimes referred to as pelletizing drums, to cause effective contact between the ore solids and reagents. Such drums, which are enclosed to collect all NOx gases generated within for recovery, were operated at a tilt of about 47 degrees from vertical and rotated at about 20 to 25 rpm.

In the first step, concentrated sulfur acid (93 wt. % $H_2SO_4$) was added to ore sample A (QTZ type) at a dosage of 25 lbs/ton of ore and 35 lbs/ton of samples B and J (QMP type) where the dosages expressed are on a 100% basis. The ore and sulfuric acid were tumbled for from 3 to 10 minutes and the acid react with basic constituents of the ore.

The acidified ore was then mixed with nitric acid (65 wt. % $HNO_3$) at a dosage equivalent to 150% of the stoichiometric requirement for sulfide sulfur in the ore sample. When necessary water was added in some runs to maintain the percent moisture to between about 8% and about 13% by weight so that satisfactory mixing is obtained. The ore and nitric acid were mixed at essentially atmospheric pressure and ambient temperature (except for a slight rise in temperature due to the exothermic reaction) for a period of about 4 hours; thereafter, the mixture was allowed to remain and cure for an additional 20 hours to determine if additional oxidation occurred. The characteristic brown-colored gas, identified as NOx, evolved immediately during contact of the ore with nitric acid. Small samples of the solids residue were taken at timed intervals, water washed and assayed for key components as reported below to determine the extent of oxidation.

At the completion of the oxidation with nitric acid, the samples were removed from the nitric acid mixing drum, stirred with water to 50% solids and conveyed to a solids separator where the slurries were poured onto a filter screen to form permeable beds. The beds were water washed by pouring water on top of the beds and allowing the water to percolate through the porous beds until the ores were thoroughly washed. The washed beds were then slurried with water to 40% solids, and mixed with lime until each slurry had a pH of about 11.0 to about 11.5. When a stable pH within this range was obtained, the neutralized samples were then leached with an aqueous sodium cyanide solution (1.0 g/l) by employing the bottle cyanidation test method.

The results of the oxidation analysis and cyanidation tests were as follows:

| Component | Oxidation/Dissolution, % Sample A | Sample B | Sample J |
|---|---|---|---|
| | 2 hours oxidation | | |
| $S^{2-}$ | 56 | 87 | 84 |
| As | 39 | 74 | — |
| Fe | 38 | 67 | 76 |
| Au in $CN^-$ | 47 | 81 | 87 |
| | 4 hours oxidation | | |
| $S^{2-}$ | 61 | 88 | 89 |
| As | 48 | 76 | — |
| Fe | 41 | 69 | 77 |
| Au in $CN^-$ | 51 | 83 | 91 |
| | 24 hours oxidation | | |
| $S^{2-}$ | 60 | 90 | — |
| As | 43 | 81 | — |
| Fe | 40 | 68 | 78 |
| Au in $CN^-$ | 53 | 91 | 90 |

After 2 hours of nitric acid oxidation, the oxidation rates were very rapid, especially the more porous samples B and J, having sulfide sulfur oxidation of 84% and 87% respectively, while sample A had only 56%. Gold dissolutions of 81% and 87% for porous samples B and J, respectively, and the lesser 47% for the more dense sample A, are large improvements over baseline tests without preliminary nitric acid oxidation.

After 4 hours of nitric acid oxidation, sulfide sulfur conversions essentially leveled off at 88% and 89% for samples B and J, respectively, while for sample A it increased 5 percentage points to 61%. Arsenic dissolution for sample A also increased 9 percentage points to 48% after four hours. Gold recoveries increased after four hours oxidation to 83% and 91% respectively, for samples B and J and to 51% for sample A.

After 24 hours nitric acid oxidation, gold recovery in samples A and J were essentially unchanged while sample B showed an 8 percentage point increase to 91% over the four hour oxidation results.

Sodium cyanide consumption varied from as low as 0.6 lbs/ton of ore to over 3 lbs/ton of ore; the average was a reasonable 1.7 lbs/ton of ore. Lime (CaO) consumptions were about 2.1 to about 3.0 lbs/ton of ore.

Example 3

The following example was carried out to demonstrate heap leaching with a cyanide lixiviate of a nitric acid oxidized ore. The test was carried out as described in Example 2 on sample J employing $HNO_3$ addition of 115% of stoichiometric for sulfide sulfur, a wash ratio (weight of wash solution to dry solids weight) of 2:1 for washing the oxidized ore, and a simulated heap leach instead of the bottle cyanidation test.

After completion of pre-acidification with sulfuric acid and nitric acid oxidation as described in Example 2, the oxidized ore was formed into a permeable bed and washed at a wash ratio of 2:1; the washed ore was then mixed in increments in a laboratory mixer until about 24 lbs/ton of lime (CaO powder) was added and the pH rose from about 2 to about 10.5 to 11.0. The laboratory mixer simulated the action of a pug mill or rotary mixer which would be used in full scale production and the mixing was carried out for about 10 to 20 minutes during which all of the lime was added.

The neutralized residue was transferred to a 4-inch diameter column and allowed to sit for 2 hours to simulate a short surge time that, in practice, likely would occur prior to emplacing the ore on a leach pad. Water percolation downflow was begun at the typical commercial rate of 0.005 gpm/ft$^2$. The initial effluent pH was 9.5 and after approximately 1-hour following breakthrough, the effluent pH was 9.8. A saturated lime water solution was then percolated for 2 hours, at which time the effluent pH had stabilized at approximately 10.8. Dilute (0.5 g/l) sodium cyanide lixiviant was percolated downflow at the flowrate of 0.005 gpm/ft$^2$. No permeability problems were encountered in the transition to a neutralized environment and the column operated well without any signs of pooling. The strongly alkaline effluent pH's verified that filtration washing and subsequent neutralization with lime were accomplished readily.

Total gold dissolution in the seven day simulated heap leaching was about 65.6% which is consistent with the low amount of nitric acid (115% of stoichiometric) employed. As higher ratios of nitric acid are employed higher amounts of gold recovery would be obtained as demonstrated in Example 2. The gold dissolution rate was high with essentially all of the gold being dissolved during the first day of leaching. Total sodium cyanide consumption totalled a reasonable 0.46 lbs/ton of ore reflecting the efficient oxidation and thorough removal of acid and soluble components in the washing of the permeable ore bed.

Example 4

The amount of nitric acid added to the curing/oxidation step was an important factor affecting sulfide conversion rates and levels and, thus, gold recoveries. Consequently, the $HNO_3$ addition was tested at from 50% to 150% of the stoichiometric requirement for $S^{2-}$. The tests were conducted on ore samples A and B, at a nominal crush of ¼ inch, and using the same procedures for oxidation, washing and neutralization, and cyanidation as for the tests described in Example 2. The curing/oxidation step was carried out for four hours. Results were:

| $HNO_3$ Stoichiometry, % | Percent Oxidation/Dissolution: Ore Sample B $S^{2-}$ | Ore Sample B Au | Ore Sample A $S^{2-}$ | Ore Sample A Au |
|---|---|---|---|---|
| 50 | 60 | 48 | 50 | 38 |
| 100 | — | 78 | 57 | 40 |
| 120 | 77 | 76 | 61 | 54 |
| 150 | 88 | 83 | 61 | 52 |

The rates and extent of oxidation increased significantly at progressively higher $HNO_3$ additions. It is likely that the higher oxidation levels were the result of more channelways that were created with increasingly aggressive $HNO_3$ conditions. Nitric acid addition as low as 50% of the stoichiometric requirements for $S^{2-}$, which is below that recommended in the present process, is reported to illustrate the improvement obtained by employing higher $HNO_3$ additions.

Sodium cyanide consumptions were approximately 1.7 to 2 lb/ton of ore, whereas, CaO consumptions typically were approximately 3 to 3.5 lb/ton of ore. There did not appear to be any direct affects on those reagent consumptions that could be ascribed to increasing $HNO_3$ dosages.

Example 5

The effects of nominal ore crush sizes of ¾ inch and ¼ inch on oxidation and gold recoveries were determined on samples A and B. The amount of $HNO_3$ addition also was varied for each ore crush size. Test procedures were the same as for Example 2. The curing/oxidation step was carried out for 4 hours.

| Ore Size | Stoichiometric $HNO_3$, % | Oxidation/Dissolutions, % Fe | $S^{2-}$ | Au Recovered in Cyanide, % |
|---|---|---|---|---|
| Ore Sample B | | | | |
| ¾-inch | 100 | 32 | 74 | 65 |
| ¾-inch | 120 | 33 | 52 | 47 |
| ¾-inch | 150 | 42 | 58 | 70 |
| ¼-inch | 100 | 60 | — | 78 |
| ¼-inch | 120 | 61 | 77 | 76 |
| ¼-inch | 150 | 69 | 88 | 83 |
| Ore Sample A | | | | |
| ¾-inch | 110 | 39 | 52 | 44 |
| ¾-inch | 138 | 38 | 51 | 43 |
| ¼-inch | 120 | 38 | 57 | 50 |
| ¼-inch | 150 | 41 | 61 | 53 |

Sulfide oxidation, in respect of rates and extent, was significantly better for both ore samples at the ¼ inch nominal crush size than at the ¾ inch nominal crush size. Similar increases in oxidation occurred on sample B, but the overall levels were higher due to the greater permeability of this sample, in contrast to that of sample A. Gold recoveries also were significantly higher at the finer ore crush sizes. In this process, where oxidation is desired within a few hours, there is insufficient time for extensive acid diffusion to occur through the larger or less porous rock fragments; consequently, the results show that it would be advantageous to employ material crushed to a nominal ¼ inch. This example illustrates that both particle size and nitric acid concentration are key factors which controlled the rate and level of oxidation and, hence, gold recoveries.

Example 6

Several tests were carried out on a nominal crush of ¼ inch sample A employing the same procedure as Example 2 except for using multiple stages of oxidation with progressive $HNO_3$ additions and interstage washing and partial drying of the residues. The curing/oxidation step was carried out for a total of 4 hours.

Typically, a total of 200% of the stoichiometric $HNO_3$ was added in four stages of 50% each, however, the distributions were varied in some tests. Samples of the residue from each stage were washed, cyanided and assayed. The multi-stage tests results are compared to those from single stage tests at 150% stoichiometric $HNO_3$. Typical multi-stage test results were:

| Test No. | $HNO_3$/ Conditions | 4-Hour Dissolutions, % Fe | $S^{2-}$ | As | Au[1/] |
|---|---|---|---|---|---|
| 36 | 100%, 1-stage | 40 | 57 | 25 | 40.1 |
| 37 | 120%, 1-stage | 38.0 | 49 | 47 | 50.1 |

-continued

| Test No. | $HNO_3$/ Conditions | 4-Hour Dissolutions, % Fe | $S^{2-}$ | As | Au[1/] |
|---|---|---|---|---|---|
| 39 | 150%, 1-stage | 41 | 61 | 48.0 | 58.0 |
| 38 | 50% + 50%, 2-stage | — | 68 | 65 | 60 |
| 70 | 4 × 50%, 4-stage | 50.1 | 74.3 | 72.4 | 63.5 |
| 72 | 4 × 50%, 4-stage | 52.3 | 73.3 | 64.4 | 58.7 |
| 76 | 100, 75, 75, 50% 4-stage | 53.0 | 76.9 | 61.0 | 53.5 |
| 77 | 100, 75, 75, 50%, 4-stage | 54.6 | 80.6 | 48.0 | 58.0 |

[1/]Au in cyanide

After four stages, oxidation levels were significantly higher than were obtained in the same time with one stage of oxidation. For example, the four hour $S^{2-}$ conversions in the four-stage tests were from 73.3% to 80.6%, in contrast to the single stage oxidation of only 61%. Gold recoveries also increased to approximately in the multiple stage tests due to increased oxidation.

Example 7

To determine the effects of controlled, externally-applied, elevated temperature on the oxidation reaction, tests were performed using the process of Example 2 in a laboratory rotating glass tube which more closely simulates a commercial type of rotary reactor (akin to a rotary kiln). The rotating glass tube in which oxidation was carried out also allowed for a controlled atmosphere, gas sweeping, and effective temperature control. Heat, when desired, was applied externally from furnace heating elements.

The tube was 5-inches diameter by 12-inches long. An ore-batch of typically 1-kg of ¼ inch ore was placed in the tube and reagents, i.e., $H_2SO_4$, followed by $HNO_3$ and water, were pumped through tubing which dripped liquid on the ore surface as the tube rotated. The feed end was connected to compressed air which was swept continuously through the tube at 3–4 liters/minute. The tube was operated at a small negative pressure of less than 1-inch of water by applying vacuum at the discharge end breech. Off-gas flow and composition were monitored continuously. A small portion of the off-gas was diluted with air and delivered to a Beckman Chemilluscent NOx monitor and recorder. The main offgas stream was scrubbed and the resultant solutions assayed for $NO_3$.

Tests were performed on ore sample A, a nominal crush of ¼ inch, at ambient temperature at different $HNO_3$ additions, as well as at elevated temperatures of 70° C. and 85° C. For sample J, also at a nominal crush of ¼ inch, the $HNO_3$ addition of 115% of stoichiometric was constant, but tests were conducted at elevated temperatures of approximately 85° C. Sample J, being much more reactive than sample A, reached non-insulated peak reactor temperatures of as high as 70° C. to 75° C. without external heat application.

Typical oxidation/dissolution results of these tests were as follows.

| Ore Sample | Reactor Temp. °C. | 3-Hour Oxidation/Dissolutions, % Fe | As | $S^{2-}$ | Au in Cyanide, % |
|---|---|---|---|---|---|
| A | 70 | 43 | 42 | 45[1/] | 54 |
| A | 85 | 38 | 38 | 46[1/] | 52 |
| J | 75 (peak non ele- | 54 | 69 | 69 | 63 |

-continued

| Ore Sample | Reactor Temp. °C. | 3-Hour Oxidation/ Dissolutions, % Fe | As | $S^{2-}$ | Au in Cyanide, % |
|---|---|---|---|---|---|
| | vated) | | | | |
| J | 75 (maintained) | 56 | 67 | 69 | 68 |
| J | 85 (maintained) | 58 | 67 | 67 | 62 |

1/2-hour oxidation time only

No significant improvement in sulfide oxidation or gold recoveries resulted that could be ascribed to elevated reaction temperatures for either sample. However, from the nitrogen distribution data, elevated temperatures caused significant increases in the deportment of $HNO_3$ to the vapor phase as NOx, as shown by the following results.

| Ore Sample | $HNO_3$, % of Stoich. | Temperature, °C. | $HNO_3$ Deportment/ Distribution, % Vapor | Residue |
|---|---|---|---|---|
| A | 50 | No adjustment (50° C.) | 60.0 | 40.0 |
| A | 100 | No adjustment (50° C.) | 65.0 | 35.0 |
| A | 120 | No adjustment (50° C.) | 72.0 | 28.0 |
| A | 100 | Elevated 75° C. | 88.0 | 12.0 |
| J | 115 | No adjustment (75° C.) | 87.40 | 2.60 |
| J | 115 | Elevated (75° C. maintained) | 99.93 | 0.07 |
| J | 115 | Elevated (85° C. maintained) | 99.49 | 0.51 |

On sample A, increasing the amount of $HNO_3$ addition caused an increase in the reactivity and, therefore, $HNO_3$ distribution to the vapor phase. The deportment of $HNO_3$ to the gas phase increased from 65% without elevated temperature to as much as 88% at 75° C. Sample J was considerably more reactive with a peak reaction temperature of 75° C. being measured, and the distribution of $HNO_3$ was as high as 97.4%. When external heat was applied to maintain 75° C. for the three hours of reaction time in the rotary vessel, the deportment of $HNO_3$ increased to as much as approximately 99.5 to 99.9%.

Maximizing the deportment of $HNO_3$ to the gas phase would be an important factor in a commercial operation, since, when the unreacted $HNO_3$ is minimized in the solids phase, the downstream effluent denitrification requirement will also be minimized considerably.

Example 8

Reactor off-gases were monitored continuously for NOx (i.e., $NO+NO_2$) content in the tests described in Example 7. The following typical results were recorded.

| Reaction Time, Minutes | NOx Volume % 1/ Sample A 50° C. | 75° C. | Sample J 75° C. Peak | 75° C. Continuous |
|---|---|---|---|---|
| 5–10 | 1 | 16 | 45 | 45 |
| 15 | 10 | 24 | 11 | 20 |
| 20 | 15 | 16 | 8 | 10 |
| 30 | 13.5 | 13 | 6 | 5 |

-continued

| Reaction Time, Minutes | NOx Volume % 1/ Sample A 50° C. | 75° C. | Sample J 75° C. Peak | 75° C. Continuous |
|---|---|---|---|---|
| 40 | 9 | 8 | 2 | 0.7 |
| 50 | 5 | 5 | 1 | 0.2 |
| 60 | 2 | 2 | 0.2 | 0.1 |
| 90 | 1 | 1 | <0.1 | <0.1 |

1/ All values corrected for air dilution

These results largely confirmed that sample J is much more reactive than sample A, with NOx concentrations of as high as 45 volume % occurring almost immediately upon contact of the ore with nitric acid. Elevated temperatures caused increased NOx off-gas concentrations, but the effect was more pronounced on the less reactive sample A. For example, in sample A after 15 minutes of oxidation, the NOx off-gas level increased to 24 volume % at a bed temperature of 75° C., from only 10 volume % when no external heat was applied.

The off-gas NOx levels in these tests; i.e., greater than 8–10 volume %, would be suitable for conventional $HNO_3$ regeneration methods.

Off-gases from the ore sample A tests were further analyzed by NOx speciation. Typically, approximately 70% of the NOx was composed of $NO_2$ and the balance as NO. Ideally, since NO is the principal nitrogen vapor product from the $HNO_3$—$S^{2-}$ reaction, the relatively high $NO_2$ levels reflect ready conversion of NO to $NO_2$ in the oxidizing (i.e., air) environment in the test. However, in the elevated temperature (i.e., 75° C.) tests, the off-gas NO level was approximately 80%. This higher $NO/NO_2$ ratio likely reflected the different vapor pressure of the gases at the higher temperature. The $NO:NO_2$ ratio is of little concern in regeneration of $HNO_3$ since all of the NO ultimately is converted to $NO_2$ prior to the absorption step.

Example 9

Filtration washing tests were performed on samples of ore that were oxidized using the rotary reactor conditions found in Example 2, except that the $HNO_3$ addition was 115% of stoichiometric requirement. The tests, which were carried out on ore sample J only, were designed to simulate a countercurrent belt filtration and washing unit although many different types of filters, extractors, and like washing equipment could be used with similar performance. In this unit, wash solution is sprayed or flooded over a bed of the oxidized ore. The solution percolates through the ore bed, under vacuum, and through the permeable filter media on which the bed reacts. Unlike ordinary filtration of fine-grained materials, in which filtration washing is accomplished primarily by solution displacement, washing of the oxidized ere in the instant example is a process not only of displacement but of diffusion as well.

One purpose of the filtration washing tests was to determine the minimum wash ratio required to achieve nearly complete nitrate and dissolved species removal from the residue. The term wash ratio in this work is defined as the weight of wash solution in relation to the residue dry solids weight. Ratios of 0.5 to 3:1 were evaluated in these tests. Wash ratios of 2 or 3 to 1 would be about the highest that would be reasonable, in practice, to ensure realistic sizing of downstream denitrification and neutralization equipment.

Filtration was performed on a bed of the oxidized ore resting on a commercially-available acid-resistant cloth (i.e., polypropylene) filter media. Typically, 1-kg of oxidized ore was stacked in a bed and washed with three separate but equal volumes of wash solution to simulate batch countercurrent washing. Each stage filtrate was kept separate for chemical analyses. The filtration time was recorded for each stage, as was the filtrate volume. The first two stages used water containing some $HNO_3$, i.e., 17 and 6 g/l for stage 1 and 2, respectively, and tap water for the third stage. Vacuum was typically 17 to 22-inches of Hg. Tests also were conducted using water only as the wash solution.

After washing was completed, the ore was transferred to a bottle, and water was added to reach 50% solids by weight. Lime (CaO) was added until a stabilized pH of approximately 10.5 to 11 was maintained, followed by cyanidation.

Test results were:

| | Test No. | | | | |
|---|---|---|---|---|---|
| 1. Dilute $HNO_3$/Water | W-1 | W-2 | W-3 | W-4 | W-5 |
| Wash Ratio | 0.53 | 1.05 | 1.56 | 2.10 | 3.14 |
| Washed-Residue & moisture | 8.7 | 7.5 | 9.7 | 11.6 | 12.9 |
| % of Soluble Species washed from solids: | | | | | |
| Fe | 81 | 90 | 93.6 | 96.2 | 97.9 |
| As | 80 | 90 | 93.2 | 96.3 | 97.9 |
| $S_{(total)}$ | 81 | 90.4 | 94.0 | 96.5 | 98.0 |
| $HNO_3$ | 83 | 93.4 | 95.2 | 97.3 | 99.5 |
| $NO_3$ | 87 | 96.8 | 98.1 | 98.9 | 99.5 |
| $S^{2-}$ Oxidation, % | 84 | 78 | 65 | 61 | 70 |
| CaO requirement, lb/ton of ore | 60.7 | 33.0 | 19.5 | 16.2 | 14.7 |

| 2. All Water | W-7 | W-9 |
|---|---|---|
| Wash Ratio | 1.05 | 2.10 |
| Washed Residue % moisture | 9.8 | 10.4 |
| % of soluble species washed from solids: | | |
| Fe | 97.5 | 97.5 |
| As | 96.3 | 96.5 |
| $S_{(total)}$ | 96.6 | 96.9 |
| $HNO_3$ | 93.3 | 96.8 |
| $NO_3$ | 98.2 | 98.8 |
| $S^{2-}$ Oxidation, % | 78.0 | 78.0 |
| CaO requirement, lb/ton of ore | 35.7 | 22.9 |

Removal of the nitrate and dissolved species from the oxidized residue was accomplished readily by filtration and washing, with the removal of soluble components largely being leveled off after a wash ratio of 2 or 3:1. At those ratios, as much as approximately 99% of the nitrate was removed, whereas from 96% to almost 98% of the iron and arsenic were removed. Extremely high washing of iron and arsenic is unnecessary in the process since small amounts of those components are readily stabilized in the subsequent cyanidation step due to the neutralization of the lime also used in cyanidation. Similar washing efficiencies were achieved using both water and dilute $HNO_3$+water. The levels of $NO_3$ in the wash water were typically 1 to 3 g/l in the all water tests and approximately 5 to 8 g/l in the mixed dilute $HNO_3$+water tests. Such levels are low enough to allow direct denitrification, for example, with countercurrent ion exchange.

Lime (CaO) requirements in the bottle neutralization step decreased significantly from approximately 60 lb/ton of ore at the lowest was ratio, to 14.7–16.2 lb/ton at the 2 and 3:1 wash ratios, ($HNO_3$+water). Similar lime consumptions occurred with water as the wash solution. The reduced lime consumptions at high wash levels likely reflected the more effective washing of residual acidity and soluble components from the residue. It would be expected that, with higher wash solutions volumes, greater diffusion of those components would occur from the porous residue. Such high porosities, which were the result of oxidation, also likely was a key factor contributing to rapid nitrate removal.

During the bottle cyanidation step, sodium cyanide consumptions were relatively low at approximately 1 lb/ton of ore or less, which indicated that the washing and neutralization objectives were achieved.

Gold recoveries were approximately 76% and 79% at the lowest wash ratios of 0.5 and 1.0:1, but decreased to 67% to 71% at higher wash ratios. Initially, it was thought that gold solubilities were influenced by the degree of washing, but, as shown in a subsequent Example 10, small changes in the nitric acid addition in oxidation had large gold recovery effects.

Effective diffusion washing is of vital importance to the success of this oxidation process since essentially all of the dissolved components (i.e., $NO_3$, $H_2SO_4$, Fe, As, etc.) must be removed to ensure good gold recovery and reasonable reagent consumptions in the subsequent cyanidation step. In particular, it is important, environmentally, to remove nitrate from the residue before it is treated to cyanidation heap leaching. The removal of dissolved components also will best ensure good permeability in the cyanidation heap leaching step.

Example 10

The effects of nitric acid dosage on gold dissolutions were optimized in this example by tests which used nitric acid addition of 125% and 140% of stoichiometric, in contrast to 115% in the Example 9 washing tests. Otherwise, the same procedure as Example 9 was employed. Results are summarized as follows:

| | Test 4 | Test 19 | Test 20 |
|---|---|---|---|
| $HNO_3$, % of stoichiometric | 115 | 125 | 140 |
| Wash ratio | 2.1 | 2.1 | 2.8 |
| % of soluble species washed from solids | | | |
| Fe | 96.2 | 95.1 | 97.1 |
| As | 96.3 | 95.3 | 97.2 |
| S | 96.5 | 95.5 | 97.3 |
| $HNO_3$ | 97.3 | 97.3 | 98.0 |
| $NO_3$ | 98.9 | 93.7 | 97.9 |
| $S^{2-}$, oxidation, % | 61 | 82 | 78 |
| CaO consumption, lb/ton of ore | 16.2 | 51.4 | 20.2 |
| Au Dissolution, % | 67 | 85 | 83 |

NOTE: All tests used water containing some nitric acid for washing as in Example 9.

Gold recoveries increased to 83% to 85% at the higher $HNO_3$ additions. Such recoveries would be satisfactory in a typical commercial setting. Slightly higher wash ratios of about 2.8 to 1 were required, however, to ensure high wash efficiencies and reasonable lime consumptions, based on the comparison between tests 19 and 20.

Example 11

Two tests were performed on ore sample A, having a nominal crush of ¾ inch where the oxidation step was performed in a laboratory pug mill and also in a pilot scale pug mill (a paddle mixer), rather than using the rotary mixer described in Example 2. A paddle mixer provides intense acid-ore contact by imparting a "squeezing" action on the particles. Such mixing method is best performed using high solids:liquid ratios, such as in the tests herein in which the moisture (i.e., as $HNO_3$, $H_2SO_4$, and $H_2O$) content of the ores were 10 to 11%.

One test used a laboratory scale simulator of a pug mill on a 2-kg ore sample, whereas, in the second test, a 100 pound sample was treated using a 18-inch wide by 36-inch long pilot scale twin paddle mixer. The tests included a $H_2SO_4$ addition of 35 lb/ton of ore followed by nitric acid at 100% of the stoichiometric requirement. Mixing times were approximately 5 and either 15 or 30 minutes, respectively, for the sulfuric and nitric acid additions. The residues were water washed, neutralized, and cyanide leached in a bottle.

| Component | Lab Pug Mill | Pilot Pug Mil |
|---|---|---|
| | 15 minute Oxidation/ Dissolution, % | |
| $S^{2-}$ | 37 | 39 |
| Fe | 23 | 32 |
| As | 23 | 31 |
| Au in cyanide | 26.7 | 38.7 |
| | 30 minute Oxidation/ Dissolution, % | |
| $S^{2-}$ | 54 | 44 |
| Fe | 30 | 32 |
| As | 38 | 33 |
| Au in cyanide | 39.7 | 40.8 |

As much as from approximately 44% to 54% of the sulfides were oxidized after 30 minutes in the pug mills. Resultants gold recoveries were approximately 40%. These results were comparable to those obtained on this less reactive ore sample in typically two or so hours in a rotary mixer. Although relatively high oxidation rates occurred in the pug mills, additional reaction time would be required to maximize oxidation levels. The use of pug milling is advantageous to minimize the overall time required to complete oxidation, reduce equipment sizes and as a preliminary mixing step for oxidation.

We claim:

1. A hydrometallurgical process for recovery of precious metals from an ore which is refractory to treatment by lixiviating agents comprising:

a. crushing the ore to no finer than about a nominal ¼ inch size, b. treating the ore in a closed reactor with about 100% to about 300% of the stoichiometric amount of nitric acid required to react with sulfides or arsenopyrite in the ore and recovering NOx gas evolved from the ore, c. forming the thus-treated ore into at least one permeable ore bed, d. water washing the ore in the permeable ore bed to remove nitric acid therefrom and yield a washed ore and separating water washings from the bed, e. forming the washed ore into a heap permeable ore bed on top of an impermeable collector, f. treating the heap permeable ore bed by dispersing continuously or intermittently a lixiviate solution for precious metals through the bed, g. separating the lixiviate solution containing dissolved precious metals from the heap permeable ore bed and recovering said precious metals from the lixiviate solution.

2. Process of claim 1 wherein recovered NOx gas is introduced into a nitric acid generator, converted to nitric acid and recycled for use in treating said ore.

3. Process of claim 1 wherein said ore is crushed to a nominal ¼ inch size up to a nominal ¾ inch size.

4. Process of claim 1 wherein said ore, prior to step b., is treated with a mineral acid in amounts to bring the ore mixture to a pH of about 2 or below.

5. Process of claim 4 wherein said mineral acid is sulfuric acid.

6. Process of claim 1 wherein said nitric acid in step b. has a concentration of from about 20% to about 70% by weight $HNO_3$.

7. Process of claim 1 wherein an acid-resistant binder is added to the nitric acid treated ore from step b. to form ore agglomerates capable of maintaining a porous bed of ore and maintaining the binder and ore in contact with one another for a sufficient curing time to permit the ore agglomerates to maintain a particulate form.

8. Process of claim 1 wherein the washed ore recovered from step d. is treated with sufficient calcium, sodium or magnesium ions under alkaline conditions to increase the pH of the washed ore to a value of about 10 or above.

9. Process of claim 8 wherein said calcium, sodium or magnesium ions are supplied by using $Ca(OH)_2$, CaO, $CaCO_3$, NaOH or $Mg(OH)_2$.

10. Process of claim 1 wherein said lixiviate solution is an aqueous solution of sodium cyanide.

11. Process of claim 1 wherein said ore is treated in steps b. through g. at essentially ambient temperatures and atmospheric pressures.

12. Process of claim 1 wherein said water washings separated in step d. are passed into an ion exchange or electrodialysis unit and $HNO_3$ is separated from the water washings.

13. Process of claim 1 wherein said ore is treated with nitric acid in step b. for from about 1 to 12 hours.

14. Process of claim 1 wherein said ore is treated with nitric acid in step b. at temperatures of from about 45° C. to about 85° C.

15. Process of claim 14 wherein said ore is treated with nitric acid in step b. at temperature reached by the exothermic reaction of said ore and nitric acid.

16. A hydrometallurgical process for recovery of precious metals from an ore which is refractory to treatment by lixiviating agents comprising:

a. crushing the ore to a nominal size of about ¼ inch to about 1 inch, b. treating the ore in a closed reactor with about 100% to about 300% of the stoichiometric amount of nitric acid required to react with sulfides or aresenopyrite in the ore and recovering NOx gas evolved from the ore, c. forming the thus-treated ore into at least one permeable ore bed, d. water washing the ore in the permeable ore bed to remove nitric acid therefrom and yield a washed ore and separating water washings from the bed, e. introducing the NOx gas recovered from the nitric acid treatment of the ore in step b. into a nitric acid generator, converting the NOx into nitric acid and recycling said nitric acid for use in treating said ore, f. treating the washed ore of step d. with sufficient calcium, sodium or magnesium ions under alkaline conditions to increase the pH of the washed ore to a value of about 10 or above, g. forming the washed ore recovered from step f. into a heap permeable ore bed on top of an impermeable collector, h. treating the heap permeable ore bed by dispersing continuously or intermittently an aqueous sodium cyanide solution as a lixiviate for precious metals through the bed, i. separating the lixiviate containing dissolved precious metals form the heap permeable ore bed and recovering said precious metals from the lixiviate.

17. Process of claim 16 wherein said ore, prior to step b., is treated with sulfuric acid in amounts to bring the ore to a pH of about 2 or below.

18. Process of claim 16 wherein the treatment of the ore with nitric acid in step b. is carried out in a plurality of treating steps.

19. Process of claim 16 wherein said nitric acid in step b. has a concentration of from about 20% to about 70% by weight $HNO_3$.

20. Process of claim 16 wherein an acid-resistant binder is added to the nitric acid treated ore recovered from step b. to form ore agglomerates capable of maintaining a porous bed of ore and maintaining the binder and ore in contact with one another for a sufficient curing time to permit the ore agglomerates to maintain a particulate form.

21. Process of claim 16 wherein said calcium, sodium or magnesium ions are supplied by using $Ca(OH)_2$, CaO, $CaCO_3$, NaOH or $Mg(OH)_2$.

22. Process of claim 16 wherein said ore is treated in steps b. through h. at essentially ambient temperatures and atmospheric pressures.

23. Process of claim 16 wherein said water washings separated in step d. are passed into an ion exchange or electrodialysis unit and $HNO_3$ is separated from the water washings.

24. Process of claim 16 wherein said ore is treated with nitric acid in step b. for from about 1 to about 12 hours.

25. Process of claim 16 wherein said ore is treated with nitric acid in step b. by carrying out a preliminary oxidation of the ore with nitric acid in a pug mill reactor followed by a curing/oxidation of the ore with additional nitric acid in a closed tubular rotary reactor.

26. Process of claim 25 wherein the curing/oxidation time in said tubular rotary reactor is from about 2 to about 12 hours.

27. Process of claim 16 wherein said ore is treated with nitric acid in step b. at elevated temperatures of about 45° C. to about 85° C.

28. Process of claim 27 wherein said ore is treated with nitric acid in step b. at temperatures reached by the exothermic reaction of said ore and said nitric acid.

29. A hydrometallurgical process for recovery of precious metals from an ore which is refractory to treatment by lixiviating agents comprising:

a. crushing the ore to no finer than nominal ¼ inch size, b. treating the crushed ore with sufficient amounts of sulfuric acid to bring the ore to a pH of about 2 or below, c. treating the ore with a total of about 100% to about 300% of the stoichiometric amount of nitric acid required to react with sulfides or arsenopyrite in the ore by carrying out a preliminary oxidation of the ore with nitric acid in at least one preliminary reactor followed by a curing/oxidation of the ore with additional nitric acid in an elongated rotary reactor for from 2 to 12 hours, d. recovering NOx gas evolved from the reaction of nitric acid with the ore in step c., e. forming the thus-treated ore into at least one permeable ore bed, f. water washing the ore in the permeable ore bed to remove nitric acid therefrom and yield a washed ore and separating water washings from the bed, g. introducing the NOx gas recovered from step d. above into a nitric acid generator, converting the NOx into nitric acid and recycling said nitric acid for use in treating said ore, h. treating the washed ore of step f. with sufficient amounts of a member selected from the group consisting of $Ca(OH)_2$, CaO, $CaCO_3$, NaOH and $Mg(OH)_2$ to increase the pH of the washed ore to a value of about 10 or above, i. forming the washed ore recovered from step h. into a heap permeable ore bed on top of an impermeable collector, j. treating the heap permeable ore bed by dispersing continuously or intermittently an aqueous sodium cyanide solution as a lixiviate for precious metals through the bed, k. separating the lixiviate containing dissolved precious metals from the heap permeable ore bed and recovering said precious metals from the lixiviate.

* * * * *